United States Patent [19]

Tseng

[11] Patent Number: 4,627,365

[45] Date of Patent: Dec. 9, 1986

[54] MOBILE GARBAGE INCINERATOR

[76] Inventor: Kuo-yuan Tseng, No. 287. tzu yu Road, Feng Shan, Taiwan

[21] Appl. No.: 779,031

[22] Filed: Sep. 23, 1985

[51] Int. Cl.[4] ..... F23G 5/40

[52] U.S. Cl. ..... 110/240; 110/214; 110/215; 110/258; 110/288

[58] Field of Search ..... 110/210, 211, 214–216, 110/235, 240, 241, 255, 257–259, 287, 288, 170, 234; 100/100

[56] References Cited

U.S. PATENT DOCUMENTS

| | | | |
|---|---|---|---|
| 3,371,629 | 3/1968 | Engdahl et al. | 110/255 X |
| 3,682,115 | 8/1972 | Rodgers | 110/240 X |
| 3,773,001 | 11/1973 | Bottalico | 110/240 X |
| 3,882,800 | 5/1975 | du Chambon | 110/215 X |
| 3,938,450 | 2/1976 | Jaronko et al. | 110/240 |
| 3,939,783 | 2/1976 | du Chambon | 110/240 |
| 4,043,280 | 8/1977 | Wray et al. | 110/258 X |
| 4,359,951 | 11/1982 | Dauvergne | 110/234 |

*Primary Examiner*—Albert J. Makay
*Assistant Examiner*—Steven E. Warner
*Attorney, Agent, or Firm*—Birch, Stewart, Kolasch & Birch

[57] ABSTRACT

A mobile garbage incinerator having an incinerator body unit. The incinerator body unit includes a hanging drum for lifting and dumping garbage into a collecting tank. Garbage is then moved into a main incinerating room for a first stage incineration process. The resulting ashes are collected and compressed. The resulting waste gases are passed into a sphere-shaped secondary incinerating room. The resulting quasi-purified air is passed into an air-circulating tank for separating dust particles. The resulting further purified air is passed through a water curtain and then passed into the atmosphere.

5 Claims, 8 Drawing Figures

MOBILE GARBAGE INCINERATOR

BACKGROUND OF THE INVENTION

Garbage is a troublesome problem. After a long-term study by experts, scholars and government officials, the best method determined to solve the garbage problem has been "incinerating" the garbage. The environment protection bureaus all over the world have invested a lot of money to construct large incinerators to solve this problem. The present method of eliminating garbage involves collecting garbage with garbage trucks which run on streets and alleys every day collecting and transporting garbage to the garbage dump for incinerating. In the past, there has been no better means than the incinerating method. The increasing high costs of this method has become a heavy burden to governments.

The garbage truck at the present time plays an important role of collecting and transporting garbage. Because the truck must pass through narrow streets, its truck body cannot be built too large. A large volume of garbage to be collected requires frequent trips of the garbage truck to a garbage dump resulting in a large expenditure for labor and truck maintenance. The increasing amount of garbage is becoming an even more troublesome problem.

In order to solve the above-mentioned problem, the inventor has provided a garbage truck which can collect garbage and then incinerate it to increase its collecting capacity, enabling it to cover a larger area without frequent trips between streets and the garbage dump reducing the cost for labor and truck maintenance and eliminating the necessity of building large incinerators. This invention will help solve the garbage problem.

Further scope of applicability of the present invention will become apparent from the detailed description given hereinafter. However, it should be understood that the detailed description and specific examples, while indicating preferred embodiments of the invention, are given by way of illustration only, since various changes and modifications within the spirit and scope of the invention will become apparent to those skilled in the art from this detailed description.

BRIEF DESCRIPTION OF THE DRAWINGS

The present invention will become more fully understood from the detailed description given hereinbelow and the accompanying drawings which are given by way of illustration only, and thus are not limitative of the present invention, and wherein.

DETAILED DESCRIPTION OF THE INVENTION

Figure 1:
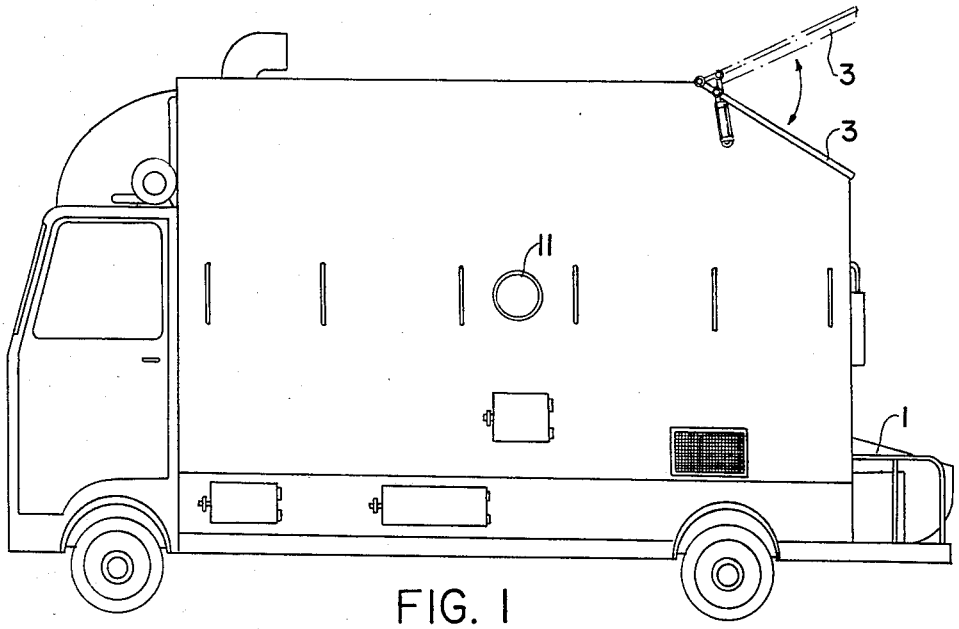
FIG. 1 is a side view of the garbage truck with an incinerating device of the present invention.

FIG. 1 shows the garbage truck having a similar body volume as a conventional garbage truck and is able to pass through streets or alleys for collecting and incinerating garbage. The garbage truck includes an automatic hanging drum, a collecting tank and a main incinerating room. The resulting garbage truck provides a greater collecting volume, reducing the need to run frequently between streets and the garbage dump.

Figure 2:
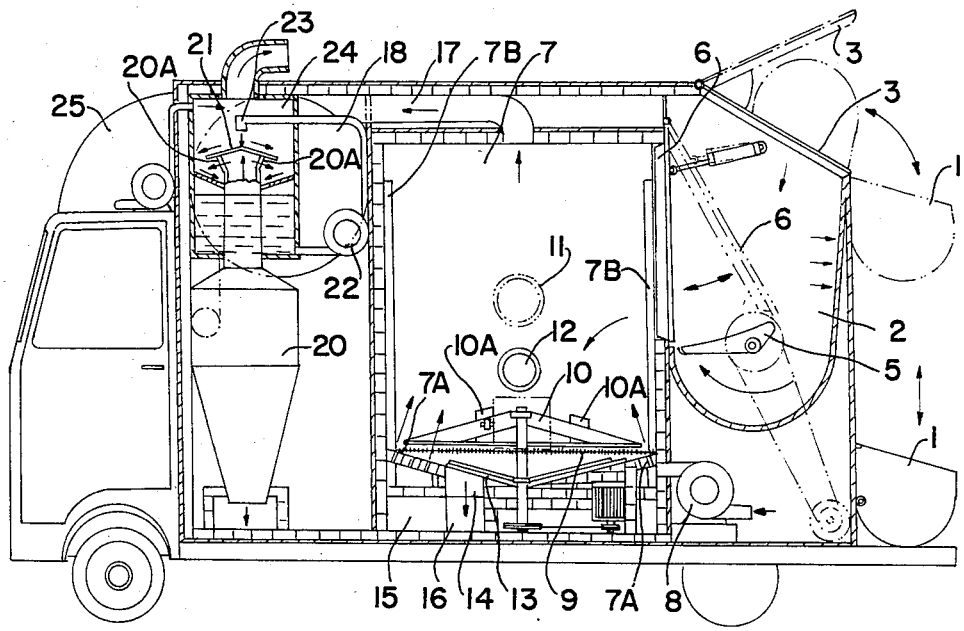
FIG. 2 is the side cross-section view of the garbage truck with an incinerating device of the present invention.
Figure 6:
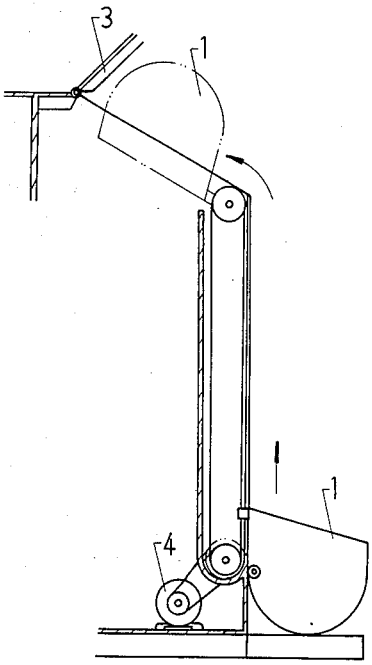
FIG. 6 is a side view of the elevating and descending means for the hanging drum of the present invention.
Figure 7:
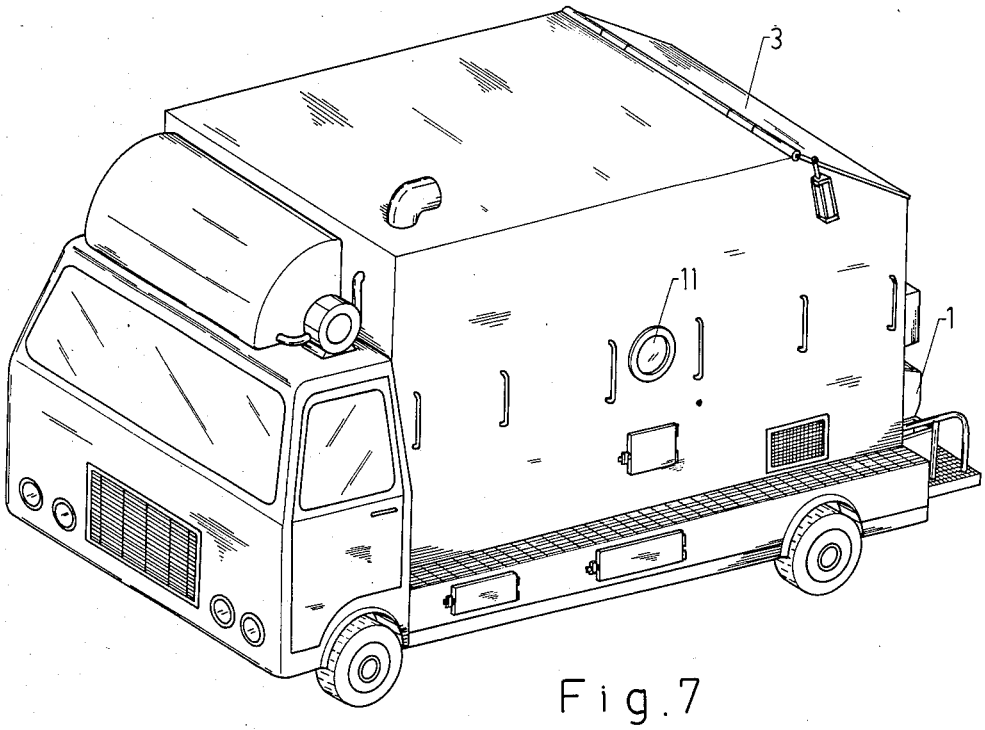
FIG. 7 is a perspective view of the garbage truck of the present invention.
Figure 8:
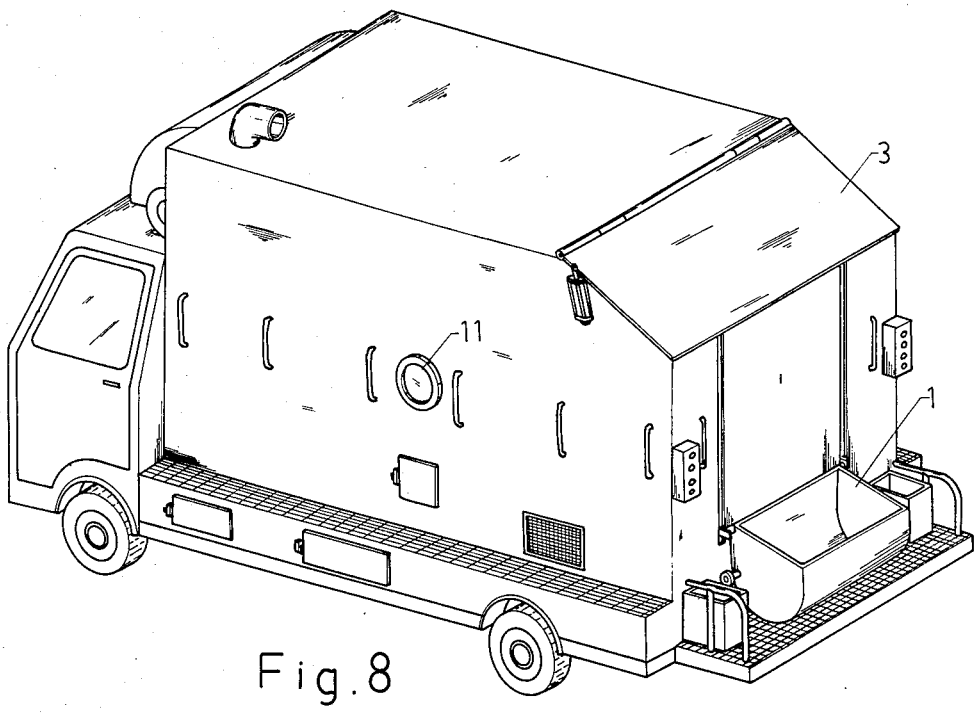
FIG. 8 is another perspective view of the garbage truck of the present invention.

In FIG. 2, the rear of the truck is provided with a hanging drum 1 with its operation shown in FIG. 6. The drum 1 can be loaded with garbage when it descends down and stops at the low position for a pre-set time. As the hanging drum descends down and stops at the low position by means of a timing circuit, the movable cover 3 is closed through the operation of a hydraulic actuator sealing the collecting tank 2 completely. When the hanging drum 1 is raised up to the top position, the movable cover 3 is opened so that the hanging drum 1 can be tilted to make the garbage drop down into the collecting tank 2.

The structure for moving the hanging drum 1 up and down is shown in FIG. 6. It is controlled by two symmetrical sets of ropes and pulleys which are driven by a speed-change motor 4 rotating clockwise or counterclockwise. Motor 4 and a set of pulleys and one rope are set up on both sides of collecting tank 2. The hanging drum 1 extends backward to the rear of the truck. The speed-change motor 4 is operated by a time circuit to rotate clockwise or counterclockwise or to remain stationary. When the wheels rotate counterclockwise, the rope lifts the hanging drum 1 up to the top and dumps the drum. When the wheels rotate clockwise, the rope lowers the hanging drum 1 down to the low position.

The garbage successively dropped into the collecting tank 2 is pushed up by a slow-moving pushing plate 5 until the pushing plate comes to a horizontal position and then pushed into a main incinerating room 7 by an incinerating room door 6 which is controlled by a hydraulic actuator to open or close alternately at a pre-set interval.

The interval between opening and shutting the incinerating room door 6 is rather long. The garbage supplied into the main incinerating room 7 is controlled according to a pre-set timer so that the frequency is not very often, ensuring that the incineration is done in the sealed main incinerating room 7 together with the aid of pressurized air provided by a blower 8 through an air opening 7A and an air tube 7B at the bottom of the main incinerating room 7.

During the time period set for closing the room door 6, the garbage falling on screen 9 is stirred loose by stirring arms 10 positioned over the screen 9. Aided by the pressurized air coming from the blower 8 (10000 RPM), the garbage will quickly burn up. Through hole 11 located on one side of the truck, we can watch the burning condition. As for the ignition of the garbage, burner 12 acts to ignite the garbage at the start or to increase the burn rate under special conditions. Burner 12 keeps the temperature inside the main incinerating room 7 constant and automatically pauses as a pre-set temperature is reached.

Figure 3:
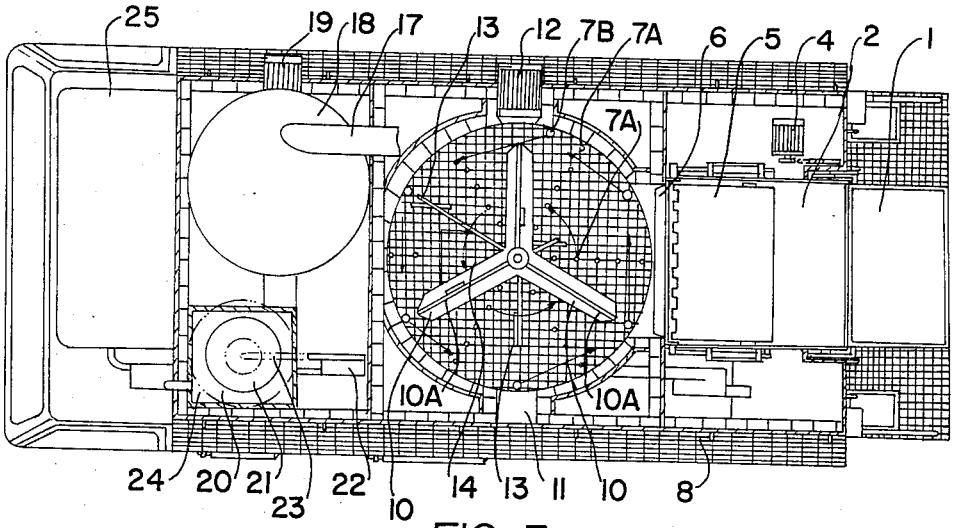
FIG. 3 is a top cross-section view of the garbage truck with an incinerating device of the present invention.
Figure 4:
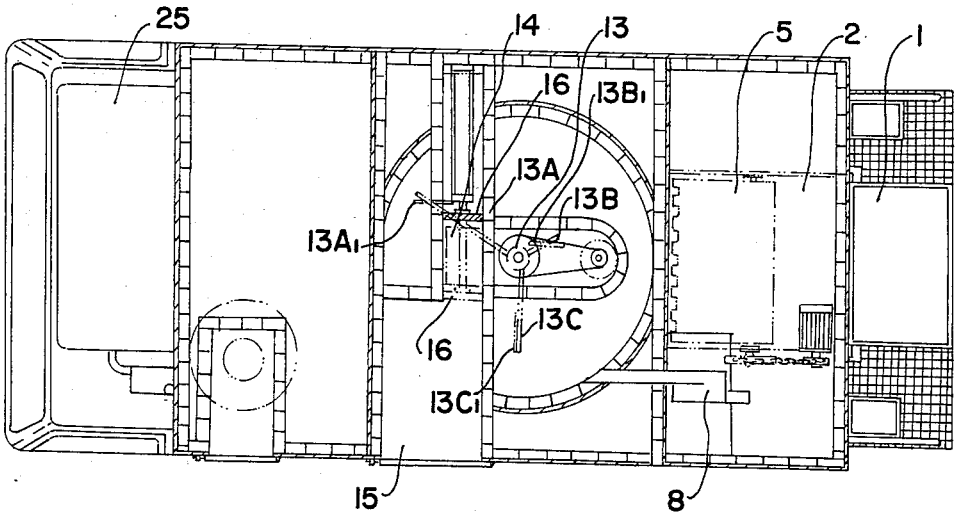
FIG. 4 is a top cross-section view of the garbage truck with an incinerating device of the present invention.

The incinerated ash in the main incinerating room 7 drops through the screen 9 to the bottom of the room and is swept by a set of ash-pushing arms 13 fixed on the same shaft of the stirring arms 10 into an ash tank 14 and then into a compressing room 15. As shown in FIGS. 3 and 4, the garbage dropping down in the main incinerating room 7 is stirred loosely by the stirring arms 10. Stirring arms 10 having stirring poles 10A (FIGS. 2 and 3) positioned at different lengths from the rotational axis of the stirring arms are used as main parts for stirring. The ash-pushing arms 13 have three poles of different length. The long pole 13A can push the outward ash inwards with an ash-moving stick $13A_1$ fixed on its end. The short pole 13B can push outwards the inside ash with an ash-moving stick $13B_1$ fixed on its end. The medium pole 13C can push the ash into the ash tank 14 with its ash-moving stick $13C_1$. The structure of the ash-pushing arms 13 is shown in FIG. 4.

In FIG. 4, the ash pushed down below the ash tank 14 by the ash-moving stick $13C_1$ of the medium pole 13C is to be compressed into a block of reduced volume by pushing plate 16 which moves to and fro by an actuator positioned on one side of the compressing room 15 functioning to press the ash into a small block which is quite convenient to handle.

Figure 5:
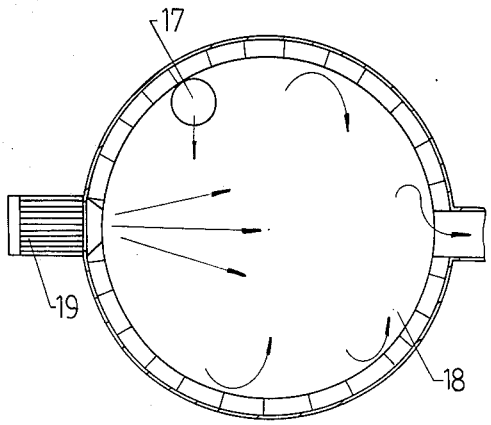
FIG. 5 is a cross-section view of the ball-shaped secondary incinerating room of the present invention.

The waste gas produced in the main incinerating room 7 is directed into a secondary incinerating room 18 via a tube 17 by high pressure air coming from the blower 8. The secondary incinerating room 18 is shaped as a sphere as shown in Figures 2 and 5. The diameters of the entrance and exit ports of the secondary incinerating room 18 are smaller than its interior diameter. Gas enters the secondary incinerating room quickly, then slows down and flows out quickly again. That is, the gas within the secondary incinerating room 18 moves slowly so that it can be sufficiently burned preventing carbon dioxide in the gas from extinguishing the fire. By slowing the flow of waste gas around the inside wall of the sphere-shaped room 18 together with the aid of the powerful burning capacity of the burner 19, all the smelly poisonous and colorful parts of the waste gas are burned completely resulting in quasi-purified air. Then the quasi-purified air is passed into an air-circulating tank 20 to separate the dust particles from the air. The further purified air is expelled out of an air hole 20A on top of air-circulating tank 20.

In the process of expelling the further purified air out air hole 20A, hydrogen chloride contained in the further purified air in high concentration is washed away through a water curtain which is formed by a suction pump 22 pumping water through a spraying tube 23. The water that evaporates out during processing is supplied by water tank 25 located on the top of the truck.

Therefore, this invention has taken into consideration many aspects, such as secondary incineration to get rid of toxicant, etc., so that it might collect garbage and completely dispose of it by means of incineration.

Moreover, since much electric power is required in this invention to operate synchronously hanging drum 1, movable cover 3, pushing plate 5, blower 8, stirring arms 10, ash-pushing arms 13 and pump 22, a power generator to be driven by the main engine of the truck is provided in this invention.

The inventor has provided an invention that can help solve garbage problems occurring in many governments around the world.

The invention being thus described, it will be obvious that the same may be varied in many ways. Such variations are not to be regarded as a departure from the spirit and scope of the invention and all such modifications as would be obvious to one skilled in the art are intended to be included within the scope of the following claims.

I claim:

1. A mobile garbage incinerator comprising:

an incinerator unit body;

a hanging drum, located at a back portion of said incinerator unit body, movable to and fro in a vertical direction between a low garbage filling position to a high garbage dumping position;

a hanging drum drive means for lifting or lowering said hanging drum between said low garbage filling position to said high garbage dumping position;

a collecting tank, located adjacent and forward of the hanging drum relative to said incinerator unit body for receiving garbage dumped from said hanging drum;

a pushing plate rotatably mounted within said collecting tank for sweeping and lifting garbage from a bottom of said collecting tank;

a movable cover located above and operatively connected to said collecting tank for opening said collecting tank to receive garbage from said hanging drum and for sealing said collecting tank after a quantity of garbage has been dumped into said collecting tank from said hanging drum for processing;

a movable cover actuating means operatively connected to said movable cover for driving said movable cover;

a main incinerating room, located adjacent and forward of said collecting tank relative to said incinerator unit body;

a first burner operatively connected to said main incinerating room for providing an incinerating flame within said main incinerating room;

an incinerating room door located between said main incinerating room and said collecting tank for pushing trash from said pushing plate into said main incinerating room, for opening said incinerating room to receive garbage from said collecting tank and for sealing said main incinerating room during a first stage incineration of trash delivered to the main incinerating room;

a blower operatively connected to said main incinerating room for providing air for the first stage incineration of garbage and for providing a high positive pressure within said main incinerating room for forcing waste gas from said main incinerating room;

a first tube operatively connected to said main incinerating room for passage of waste gas from said main incinerating room;

a secondary incinerating room operatively connected to said main incinerating room by said first tube;

a second burner operatively connected to said secondary incinerating room for providing an incinerating flame within said main incinerating room;

a second tube operatively connected to said secondary incinerating room for passage of quasi-purified air from said secondary incinerating room;

an air-circulating tank operatively connected to said secondary incinerating room, by said second tube, for separating dust particles from the quasi-purified air including an exit hole for expelling further purified air from said air-circulating tank;

a water curtain located above and surrounding said exit air hole for washing the expelled further purified air; and an exhaust port for releasing the washed air from the mobile garbage incinerator into the atmosphere.

2. The mobile garbage incinerator according to claim 1 in which said hanging drum drive means comprises:

a first pair of lower pulleys located on either side of the incinerator unit body;

a second pair of pulleys displaced above said first pair of pulleys located on either side of the incinerator unit body;

a pair of connecting members, each connecting member guided around one of said first pulleys and one of said second pulleys located on the same side of the incinerator unit body;

said hanging drum operatively connected to said pair of connecting members;

a pair of speed-change motors each operatively connected to one of said first pulleys each capable of rotating clockwise or counterclockwise for raising or lowering said hanging drum;

a time circuit;

said pair of speed-change motors are controlled by said time circuit for rotating said pair of first pulleys and in turn driving said hanging drum to and fro between said low garbage filling position to said high garbage dumping position.

3. The mobile incinerator according to claim 1, including:

a screen located within and near a bottom of said main incinerating room;

a plurality of stirring arms located above said screen for agitating garbage resulting in more complete burning of the garbage and for forcing ash through said screen resulting from the first stage incineration of garbage;

an ash tank located below said screen for receiving ash passed through said screen; and a plurality of ash-pushing arms located below said screen for pushing ash into said ash tank.

4. The mobile garbage incinerator according to claim 3, including:

a compressing room located below and operatively connected to said ash tank;

an actuator operatively connected to a plate located within said compressing room for compressing ash within the compressing room received from said ash tank.

5. The mobile garbage incinerator according to claim 3 including:

a motor driven axle located within said main incinerating room;

said plurality of stirring arms and said plurality of ash-pushing arms are operatively connected and extend radially from said axle and revolve about the bottom of the main incinerating room for agitating garbage, for providing a more efficient combustion of the garbage and for removing ash above and below said screen into said ash tank.

* * * * *